US006055889A

United States Patent [19]

Rinner

[11] Patent Number: 6,055,889

[45] Date of Patent: May 2, 2000

[54] HAND MANIPULATED TORQUE TRANSMITTING TOOL

[75] Inventor: James A. Rinner, Racine, Wis.

[73] Assignee: Beere Precision Medical Instruments, Inc., Racine, Wis.

[21] Appl. No.: 09/228,130

[22] Filed: Jan. 11, 1999

[51] Int. Cl.[7] ..... B25B 23/16

[52] U.S. Cl. ..... 81/177.85; 81/489

[58] Field of Search ..... 81/177.1, 177.85, 81/489

[56] References Cited

U.S. PATENT DOCUMENTS

| | | | |
|---|---|---|---|
| D. 148,621 | 2/1948 | Herman | 81/177.1 |
| 4,779,493 | 10/1988 | White | 81/438 |
| 4,905,549 | 3/1990 | Nickipuck | 81/177.85 |
| 5,289,745 | 3/1994 | Beardsley | 81/177.2 |
| 5,442,980 | 8/1995 | Ringer | 81/177.85 |
| 5,685,208 | 11/1997 | Tidwell | 81/177.85 |
| 5,720,207 | 2/1998 | Milner et al. | 81/177.85 |

*Primary Examiner*—James G. Smith
*Assistant Examiner*—David B. Thomas
*Attorney, Agent, or Firm*—Arthur J. Hansmann

[57] ABSTRACT

A hand manipulated torque transmitting tool having a handle and two tool shank-receiving cavities therein. A shank retainer ball extends into each cavity, and the shank has a circular groove therearound for receiving said ball when in either cavity. The shank has a square drive end mating with a square hollow of said cavities, for four-corner drive from said handle to said shank.

12 Claims, 3 Drawing Sheets

13
13

HAND MANIPULATED TORQUE TRANSMITTING TOOL

This invention relates to a hand manipulated torque transmitting tool, and, more particularly, it relates to that type of tool with a removable and replaceable tool bit, such as a screwdriver bit.

BACKGROUND OF THE INVENTION

This particular invention pertains to the torque transmitting tool wherein the tool bit is replaceably held in the handle portion of the tool and is held therein by means of a ball and groove interconnection between the handle itself and the shank of the tool bit. In the present instance, the ball and groove connection is arranged to be most secure and reliable, and it is also arranged in combination with a square type of drive between the handle and the bit, that is, there are four corners in the cavity of the handle and also on the shank of the bit, for optimum drive torque and minimal lost motion therebetween.

In addition to the aforementioned, the handle body is arranged to control the position of the securing ball and to do so by an arrangement of a control member movable on the body and being controlled by the operator for positioning the ball in either the bit holding position or the bit released position. The bit holding position is automatically achieved.

Still further, the handle is arranged for reception of the releasable bit in two different and right angle related positions on the handle itself, and thus the operator can apply respective hand force on the handle to accommodate the location of the bit in either of the two positions mentioned.

In this specific arrangement constituting this invention, there is no requirement for a spring-urged ball to hold a replaceable tool bit to a handle, and thus the inherent degree of failure of that type of spring-urged ball connection is avoided in the present invention. That is, the present invention does not rely upon any spring-urged ball which, by virtue of the spring resilience, is subject to inadvertent release of the tool bit from the handle body itself.

The present invention utilizes a tool bit drive which is square in its cross-sectional shape and between the handle cavity and the shank of the tool bit, and thus optimum force and reliability exist between the torque force applied to the handle and that transmitted to the tool bit itself, and, as such, there is optimum efficiency of transmitting the force without lost motion therebetween and without ultimate damage to the corners of the inter-engaged drive between the handle and the tool bit shank.

Further, the circular mating between the handle body and the tool bit provides stablility therebetween.

DETAILED DESCRIPTION OF THE PREFERRED EMBODIMENTS

Figure 1:
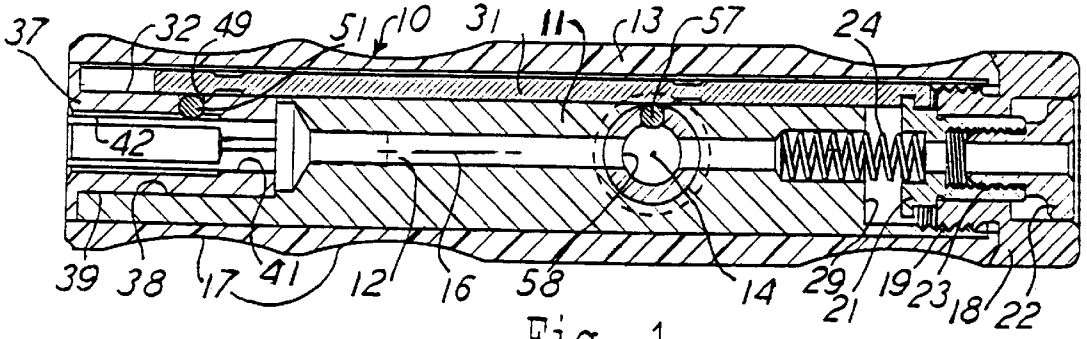
FIG. 1 is a longitudinal sectional view through an embodiment of this invention, and being taken substantially along the plane designated 1—1 on FIG. 3.
Figure 3:
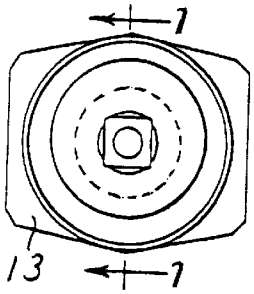
FIG. 3 is an end elevational view of FIG. 1.
Figure 2:
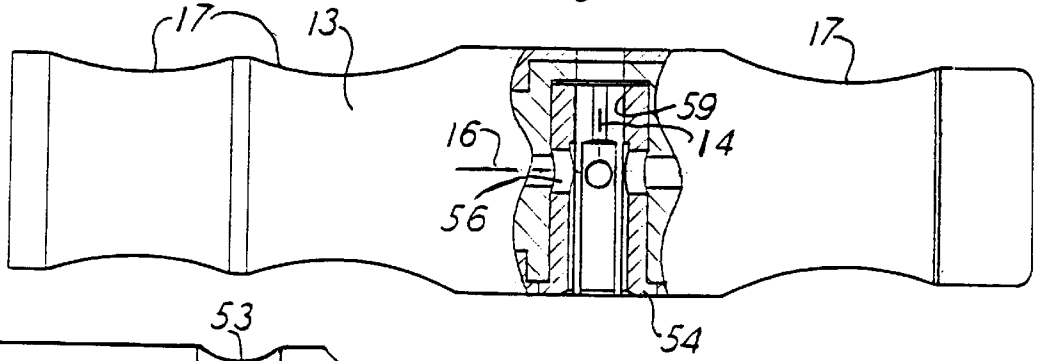
FIG. 2 is a bottom elevational view of FIG. 1, with parts broken away.

FIGS. 1, 2, and 3 show an embodiment of the invention with a handle generally designated 10 and including a cylindrically shaped body portion 11 having an axially extending longitudinal opening 12 therethrough. The body 11 is made of aluminum, and it also has a surrounding cover 13 which is of a silicone material molded to the exterior of the then body core 11. Accordingly, it will be seen and understood that the handle 10 is suitable for gripping and torquing about the longitudinal axis along the central opening 12, as seen in FIG. 1, and it is also shaped and suitable for gripping or turning about an axis perpendicular to the longitudinal axis 12, namely, an axis designated 14 in FIG. 2. In the FIG. 2 function, the handle thus serves as a T-handle. In both instances, it would be seen and understood that working tools, such as screwdriver bits, can be placed to extend along either longitudinal axis 14 of FIG. 2 or a longitudinal axis 16 extending along the cylindrical opening 12 of FIG. 1. That is, the molded cover 13 has ergonomic compatible shapes, such as at 17, for conforming to the user's hand in either direction of bit rotation.

Figures 5, 6, 7, 8, 9, 10, 11, 12, 13, 14:
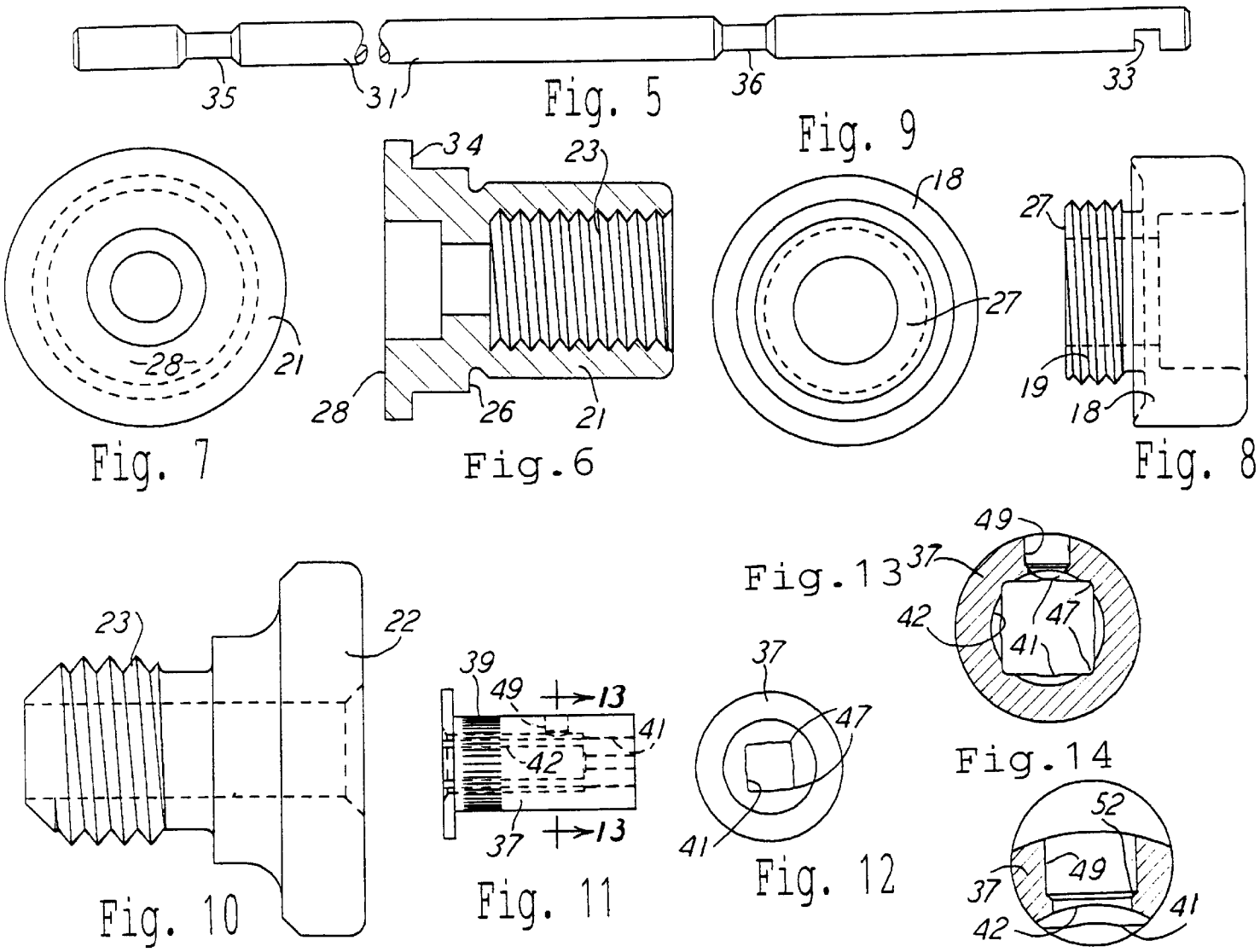
FIG. 5 is an enlarged view of a part of FIG. 1, fragmentarily shown.
FIG. 6 is an enlarged sectional view of a part shown in FIG. 1.
FIG. 7 is a left side elevational view of FIG. 6.
FIG. 8 is an enlarged elevational view, in full, of a part shown in FIG. 1.
FIG. 9 is a left side elevational view of FIG. 8.
FIG. 10 is an enlarged view, in full, of a part shown in FIG. 1.
FIG. 11 is a side elevational view, in full, of a part shown on the left end in FIG. 1.
FIG. 12 is a right end elevational view of FIG. 11.
FIG. 13 is an enlarged sectional view taken along the lines designated 13—13 in FIG. 11.
FIG. 14 is an enlarged sectional view of the upper portion of FIG. 13.
Figure 15:
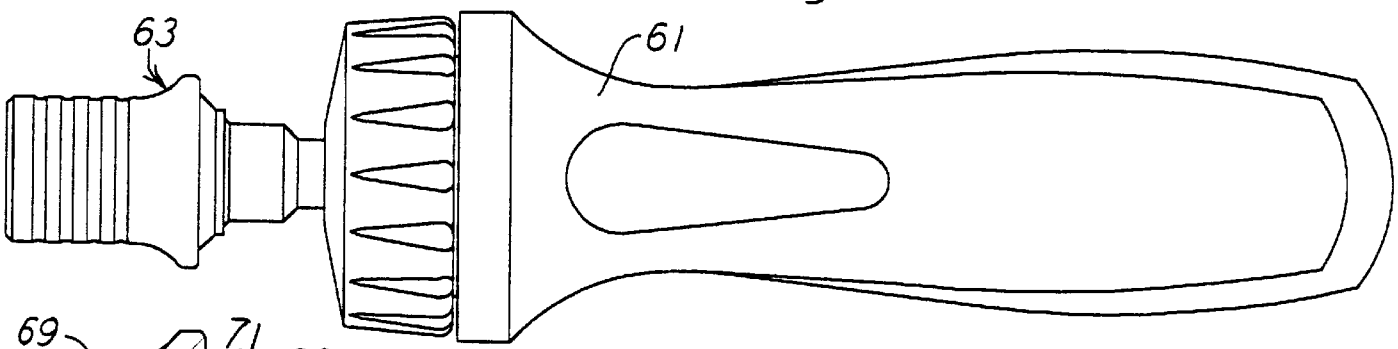
FIG. 15 is a side elevational view of another embodiment of this invention and showing a drive handle therewith.
Figure 19:
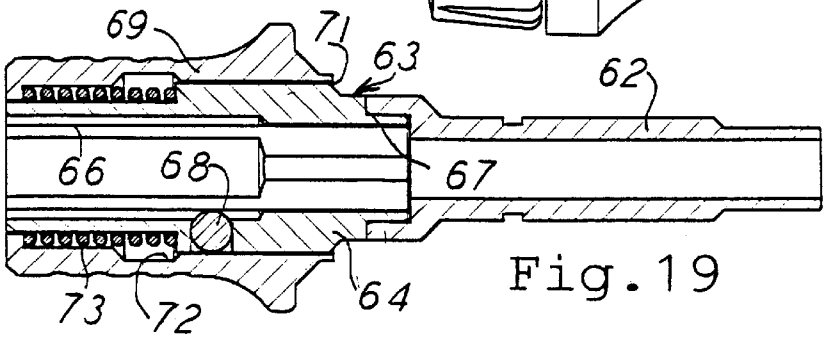
FIG. 19 is a longitudinal sectional view of the showing of FIG. 16.
Figure 16:
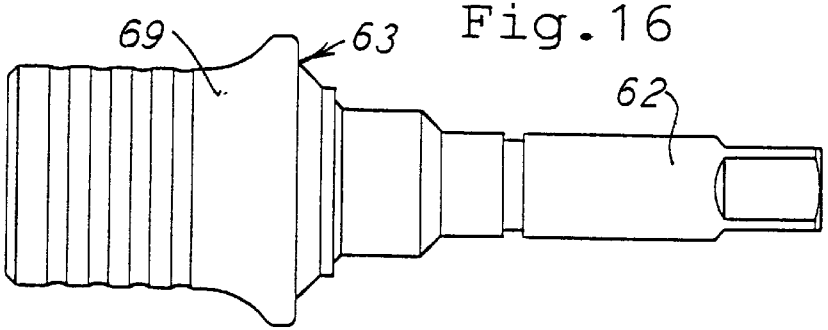
FIG. 16 is an enlarged view of a portion of FIG. 15.
Figure 17:
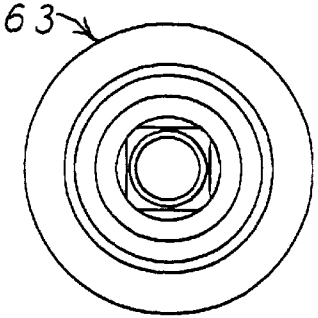
FIGS. 17 and 18 are right side and left side, respectively, elevational views of FIG. 16.
Figure 18:
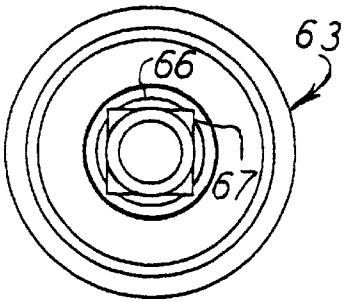

One end of the handle 10 includes a cylindrical collar 28 threaded to the body 11 as at 19. An assembly of a cylindrical plunger 21 and a cylindrical button 22 are threadedly connected at 23 and slidably extend within the central cylindrical opening of the collar 18. A compression spring 24 extends axially of the handle 10 and bears against the plunger 21 to urge the assembly of the plunger 21 and the button 22 rightwardly, as viewed in FIG. 1. The limit of movement to the right is established by a cylindrical shoulder 26 on the plunger 21, as seen in FIG. 6, and that shoulder 26 bears against the end 27 of the collar 18, as seen in FIG. 8. Conversely, the assembled button 22 and plunger 21 can move leftward, as viewed in FIG. 1, to where the end wall 28 of the plunger 21 bears against the base 29 of the end bore shown in the body core 11, as seen in FIG. 1.

Also, as seen in FIGS. 1 and 5, a shaft 31 extends along the length of the handle 10, and is disposed in a longitudinal groove 32 in the handle body core 11. The shaft 31 has a notch 33 for receiving a portion of the cylindrical shoulder 34 of the plunger 26, and thus the shaft 31 moves longitudinally along with the movement of the plunger 21. It will also be seen that the shaft 31 has two reduced cross-sectional portions 35 and 36 for a purpose hereinafter described.

Figure 4:
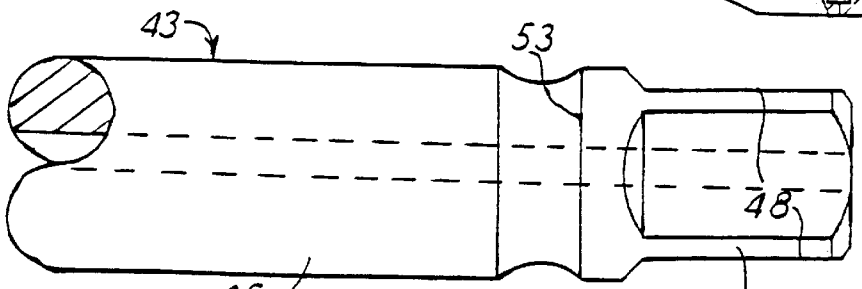
FIG. 4 is an enlarged view of a fragment of a bit received in the handle of the previous views.

A cylindrical collar 37 is fixedly pressed into a central bore 38 in the body core 11, and thus the cylindrical exterior of the collar 37 can be narrowed at 39 for fixed positioning relative to the body core 11 in the FIG. 1 positioning. FIGS. 11 and 12 show the collar 37 and the knurling at 39, and they also show a square cross-sectional shape 41 extending longitudinally of the collar 37 and at the interior end thereof relative to the body 10. At the exterior end of the collar 37, there is a longitudinally extending and cross-sectional circular shape of 42 which is contiguous to the square shape 41. As such, FIG. 4 shows an enlarged tool bit, such as a screwdriver shank 43 which has a square end 44 for being snugly received in the square opening 41, and which also has a cylindrical portion 46 which is snugly received in the cylindrical opening 42. As such, there is a square drive connection between the bit shank 43 and the tool handle 10. Thus, all four corners 47 of the square opening 41 are active for snugly receiving the four corners 48 of the bit 43, and thus the optimum rotational torque is transmitted from the handle 10 to the bit 43 with all four corners 47 engaged with the bit 43 to avoid any slippage therebetween and to distribute the force between the handle and the bit with that distribution being at all four corners 47 and the four corners 48.

FIGS. 1, 11, 13, and 14, show that the collar 37 has a cylindrical passageway 49 extending therethrough to the interior cylindrical opening 42. A spherical ball 51 is shown in FIG. 1 to be disposed within the opening 49 and it projects slightly into a cylindrical opening 42 in the collar 37. A circular shoulder 52 is of a reduced cross-sectional size at the termination of the cylindrical opening 49, and thus only a portion of the ball 51 can project into the opening 42, and therefore the ball 51 always remains trapped in the collar 37, but movable up and down in the cylindrical opening 49 and projectable into the cylindrical opening 42.

FIG. 4 shows that the bit shank has a circular groove 53 extending therearound, and, when the bit 43 is slid into the collar 37, the circular groove 53 is in line with the ball 51 in the fully seated position in the handle 10. As such, the ball 51 will preclude axial movement of the bit 43 relative to the handle 10 when the ball 51 is urged downwardly into the groove 53, and that urging is achieved where the shaft 31 is in the position shown in FIG. 1, namely, when the shaft 31 is in contact with the ball 51 at a portion of the shaft other than the circular recess 37 of the shaft 31

Conversely, when the shaft 31 is moved leftward, as viewed in FIG. 1, then the recess 35 aligns with the ball 51 to permit the ball to move away from the shank groove 53, and thus release the shank 43 from the handle 10 by an axial pull on the bit 43. That release is achieved by the movement of the shaft 31, as mentioned, and that movement is achieved by the operator pressing on the button 22 to displace the plunger 21 and thus displace the shaft 31 for the bit release mentioned. Thus for both release and insertion of the bit 43 relative to the handle 10, the operator will depress the button 22 to permit the ball 51 to move radially relative to the cylindrical opening 42 in the collar 37 and thus permit the axial movement of the shank 46 relative to the collar 37. Also, the spring 24 automatically returns the shaft 31 to the position shown in FIG. 1 when the operator releases the thumb or like pressure on the button 22, and thus the bit will be in the latched position if and when it had been inserted into the handle 10 as mentioned.

With the unique arrangement of the square drive and the completely circular shank recess 53, the optimum drive relationship between the handle and the bit is achieved, as mentioned, and the bit can be inserted in any position where the square socket receives the bit. There is security in retaining the bit 43 in the handle 10 with the square drive and cylindrical groove, as described herein.

FIGS. 1 and 2 also show another collar 54 which is generally configured like the collar 37, but it has a transverse passageway 56 extending therethrough. Otherwise, the collar 54 also receives the bit 43, and there is a cylindrical ball 57 in the collar 54 and extending down into the collar's cylindrical opening 58, all for the purpose mentioned with regard to the collar 37 and the ball 51. Of course the collar 54 also the square socket 59 extending longitudinally therein, just as with that of the collar 37.

With that arrangement, the bit 43 can be placed transverse to the longitudinal direction of the handle 10 and that is when the bit 43 is inserted into the longitudinal axis of the collar 54.

In both instances of location of the bit 43, as described, there is cannulation in that the various assembled parts, as seen in FIG. 1, all have a longitudinally extending opening therethrough so that there is one complete passageway from end to end in the handle 10, and thus a wire or the like can be fed through that opening for purposes of guidance through the handle 10. That, of course is done with the understanding that the bit 43 itself would have a longitudinal opening for permitting the passage of the wire through the handle and through the bit, and that can be a conventional arrangement such as for use in the medical field. In that regard, the collar 54 has its transverse passageway 56 for the passage of the wire along the axis 16.

In the arrangement where the bit is in the collar 54, it will be seen and understood that the shaft 31 has its recessed groove 36 which can align with the ball 57 for release of the bit 43 by means of the ball 57 being movable away from the bit groove 53 for both the insertion and the release of the bit 43 relative to the handle 10.

FIGS. 15 through 19 show a somewhat different arrangement for the invention, and here a handle 61 has a conventional axially extending opening for receiving a shank 62 of an adapter generally designated 63. That is, the adapter 63 is conventionally inserted into the axial end of the handle 61 to be rotationally drive-related thereto.

Affixed to the shank 62 is an adapter body 64 which has a longitudinally extending circular opening 66 and a contiguous extending square opening 67, with both openings extending axially of the adapter body 64, as with the collar 37, for instance. Again, a spherical ball 68 is movable relative to and is controlled by the body 64 to have the sphere move toward and away from the cylindrical opening 66. Thus the ball 68 can be engaged with the cylindrical groove 53 when the bit square end 44 is in the square opening 67.

A sleeve 69 is slidable over the body 64, and is retained thereby by a swaging at 71 to be restricted in leftward movement. However, the sleeve 69 can move rightward and thereby have a groove 72 therein align with the ball 68 to permit the ball to move out of the bit groove 53 for thus release of the bit 43. A compression spring 73 urges the sleeve 69 leftward to the position shown in FIG. 19, and thus the ball 68 is urged toward the opening 66 and into the groove 53 when the shank is in its seated position mentioned.

Again, that showing of the invention reveals the arrangement of the square drive with the circular bit groove 43 and the ball 68 thus being available for seating in the groove 53 in any one of the four angulated positions of insertion of the bit 43 into the handle 61. There is maximum holding of the bit 43 relative to the handle 61 and it takes positive action to release the bit 43, and it also gives the optimum driving force between the square bore or opening 67 and the square end 48 of the bit 43.

What is claimed is:

1. A hand manipulated torque transmitting tool, comprising a handle body having a longitudinal axis and a central cavity at one axial end of said body and extending along said axis to an exterior end of said body, said cavity being configured in planes transverse to said axis to have both a square shape and a circular shape extending co-axially and in end-to-end relationship along said axis and with said circular shape being disposed at said exterior end and with said square shape being disposed spaced inwardly from said exterior end and with said square shape having four flat sides and four corners extending parallel to said axis, a driven shank with an elongated axis and being co-axially and slidably disposed in said cavity and having a cross section transverse to its axis with a squared length with four flat sides and four exterior corners matching and in snug contact with said four corners of said cavity, and thereby be in rotational driven relation with said body about said elongated axis, and having a circular length with a circular cross section co-axial to said squared length and being and snug within said circular shape, said shank having an externally disposed groove extending completely therearound on said circular length, and a ball movably supported in said body for movement toward and away from said shank and being releasably urged into said cavity and into said shank groove for releasably holding said shank axially in said cavity.

2. The hand manipulated torque transmittng tool as claimed in claim 1, including a ball-control member movably and supported on said body and disposed in contact with said ball to releasably hold said ball in said groove.

3. The hand manipulated torque transmitting tool as claimed in claim 2, wherein said member is a rod slidable in said body and has a relief facing said ball for reception of said ball when adjacent to said ball to thereby release said ball from said groove.

4. The hand manipulated torque transmitting tool as claimed in claim 3, wherein said rod extends for substantially the length of said body from the end thereof opposite said one end and to said one end.

5. The hand manipulated torque transmitting tool as claimed in claim 4, including a spring disposed on said body and arranged to urge said rod relative to said ball and into a position for holding said ball in said groove, and a button movable on said body and engaged with said rod for urging said rod into holding said ball.

6. The hand manipulated torque transmitting tool as claimed in claim 1, including an additional cavity in said body and extending transverse to the first said cavity and having the exact interior shape as claimed for the first said cavity, said shank being movably supported in said additional cavity as an alternate position for said shank with regard to its position in the first said cavity, and an additional ball movably supported in said body for movement toward and away from said shank and being releasably urged into said additional cavity and into said groove of said shank for releasably holding said shank in said additional cavity.

7. The hand manipulated torque transmitting tool as claimed in claim 6, including a rod slidably disposed in said body and intersecting both said cavities and having reliefs disposed in each of said cavities for respective reception of said balls when said reliefs are respectively adjacent said balls to thereby release said balls from said groove.

8. The hand manipulated torque transmitting tool as claimed in claim 7, wherein said rod extends for substantially the length of said body from the end thereof opposite said one end and to said one end.

9. The hand manipulated torque transmitting tool as claimed in claim 8, including a spring disposed in said body and arranged to urge said rod relative to said balls and into a position for holding said balls respectively in said grooves, and a button movable on said body and engaged with said rod for urging said rod into position to hold said balls in the respective said grooves.

10. A hand manipulated torque transmitting tool, comprising a body having a longitudinal axis and a central cavity at one axial end of said body and extending along said axis to an exterior end of said body, said cavity being configured to be square in shape transverse to said axis and being fully disposed spaced inwardly from said exterior end and having four flat sides and four corners extending parallel to said axis, and said cavity being circular in shape adjacent to said exterior end and contiguous to said square shape, and with said shapes being disposed in end-to-end relationship and co-axially along said axis, a driven shank with an elongated axis and being coaxially and slidably disposed in said cavity and having a cross section transverse to its axis with a square form having four flat sides and four exterior corners matching and in contact with said four corners of said cavity, and thereby be in rotational driven relation with said body about said elongated axis, and having a circular length with a circular cross section co-axial to and contiguous to said square form and being and snug within said circular shape, said shank having an externally disposed circular groove extending endlessly therearound on said circular length, a ball movably supported in said body for movement toward and away from said shank and being releasably urged into said cavity and into said shank groove for releasably holding said shank axially in said cavity, and a ball control member movable on said body and extending exteriorly of said body and into contact with said ball in one position of movement of said ball control member for holding said ball in said groove.

11. The hand manipulated torque transmitting tool as claimed in claim 10, wherein said ball control member is supported on said body to be slidable thereon over said ball and includes a recess therein for receiving said ball to permit said ball to move out of said groove, and a spring on said body and in contact with said ball control member for urging said ball control member away from said one position and thereby release said shank from said body.

12. The hand manipulated torque transmitting tool as claimed in claim 11, wherein said ball control member is a sleeve slidable on said body surrounding said cavity and said ball and said spring.

* * * * *